US008896508B2

(12) United States Patent
Matsumoto

(10) Patent No.: US 8,896,508 B2
(45) Date of Patent: Nov. 25, 2014

(54) ELECTRO-OPTICAL DEVICE, DRIVING METHOD THEREFOR, AND ELECTRONIC APPARATUS

(75) Inventor: Tetsuro Matsumoto, Chino (JP)

(73) Assignee: Seiko Epson Corporation, Tokyo (JP)

( * ) Notice: Subject to any disclaimer, the term of this patent is extended or adjusted under 35 U.S.C. 154(b) by 669 days.

(21) Appl. No.: 12/777,735

(22) Filed: May 11, 2010

(65) Prior Publication Data

US 2010/0289731 A1 Nov. 18, 2010

(30) Foreign Application Priority Data

May 12, 2009 (JP) ..... 2009-115522

(51) Int. Cl.
*G09G 3/36* (2006.01)
*G09G 3/20* (2006.01)

(52) U.S. Cl.
CPC ..... *G09G 3/2025* (2013.01); *G09G 2320/041* (2013.01); *G09G 3/3648* (2013.01)
USPC ..... 345/87; 345/89; 345/602

(58) Field of Classification Search
CPC . G06G 3/2022; G06G 3/3648; G06G 3/2033; G06G 2320/041; G06G 2360/16; G06G 2360/18
USPC ..... 345/3.2, 76, 96, 98, 99, 100, 540, 89, 345/589, 690, 87, 602; 315/169.3; 348/448
See application file for complete search history.

(56) References Cited

U.S. PATENT DOCUMENTS

| | | | | |
|---|---|---|---|---|
| 6,278,436 | B1 * | 8/2001 | Hosoi et al. | 345/30 |
| 7,635,863 | B2 * | 12/2009 | Yamazaki et al. | 257/59 |
| 2002/0154082 | A1 * | 10/2002 | Zavracky et al. | 345/88 |
| 2004/0207588 | A1 | 10/2004 | Shiomi | |
| 2005/0007360 | A1 * | 1/2005 | Matsumoto | 345/204 |
| 2005/0062712 | A1 * | 3/2005 | Noda | 345/101 |
| 2005/0184944 | A1 * | 8/2005 | Miyata et al. | 345/89 |
| 2007/0080905 | A1 * | 4/2007 | Takahara | 345/76 |
| 2007/0152945 | A1 * | 7/2007 | Park et al. | 345/98 |
| 2007/0194314 | A1 * | 8/2007 | Yamazaki et al. | 257/66 |
| 2008/0180385 | A1 * | 7/2008 | Yoshida et al. | 345/102 |
| 2008/0231587 | A1 | 9/2008 | Takahashi | |
| 2008/0284700 | A1 * | 11/2008 | Oke et al. | 345/89 |
| 2008/0284768 | A1 * | 11/2008 | Yoshida et al. | 345/208 |

FOREIGN PATENT DOCUMENTS

| | | |
|---|---|---|
| JP | A-06-230750 | 8/1994 |
| JP | A-2000-356976 | 12/2000 |
| JP | A-2001-331144 | 11/2001 |
| JP | A-2001-337642 | 12/2001 |
| JP | A-2004-177575 | 6/2004 |
| JP | A-2004-325496 | 11/2004 |
| JP | A-2005-077946 | 3/2005 |
| JP | A-2005-215128 | 8/2005 |
| JP | A-2005-258465 | 9/2005 |
| JP | A-2007-304561 | 11/2007 |
| JP | A-2008-233738 | 10/2008 |

* cited by examiner

*Primary Examiner* — Michael J Eurice
(74) *Attorney, Agent, or Firm* — Oliff PLC

(57) ABSTRACT

An electro-optical device includes a temperature detecting unit that detects temperature, wherein the electro-optical device sets a number of sub-frames of plural sub-frames included in one frame according to the temperature detected by the temperature detecting unit and sets a luminance level of pixels in each of the plural sub-frames to at least a first level or a second level to perform gradation display.

6 Claims, 11 Drawing Sheets

BLACK DISPLAY CODES

| | | GRADATION CODES | KEEP CODES |
|---|---|---|---|
| SF / GRADATION | 1 2 | 3 ···· 12 | 13 ····· 81 |
| 0 GRADATION | 11 | 1111 1111 11 | 11 1111 1111 1111 1111 1111 1111 1111 1111 1111 · · · |
| 1 GRADATION | 11 | 0111 1111 11 | 10 1010 1010 1010 1010 1010 1010 1010 1010 1010 · · · |
| 2 GRADATION | 11 | 0011 1111 11 | 10 1010 1010 1010 1010 1010 1010 1010 1010 1010 · · · |
| 3 GRADATION | 11 | 0101 1111 11 | 10 1010 1010 1010 1010 1010 1010 1010 1010 1010 · · · |
| 4 GRADATION | 11 | 0001 1111 11 | 10 1010 1010 1010 1010 1010 1010 1010 1010 1010 · · · |
| 5 GRADATION | 11 | 0010 1111 11 | 11 0011 0011 0011 0011 0011 0011 0011 0011 0011 · · · |
| 6 GRADATION | 11 | 0000 1111 11 | 11 0011 0011 0011 0011 0011 0011 0011 0011 0011 · · · |
| 7 GRADATION | 11 | 0001 0111 11 | 11 0011 0011 0011 0011 0011 0011 0011 0011 0011 · · · |
| 8 GRADATION | 11 | 0000 0111 11 | 11 0011 0011 0011 0011 0011 0011 0011 0011 0011 · · · |
| 9 GRADATION | 11 | 0010 0111 11 | 11 0011 0011 0011 0011 0011 0011 0011 0011 0011 · · · |
| 10 GRADATION | 11 | 0000 0011 11 | 11 1000 1110 0011 1000 1110 0011 1000 1110 0011 · · · |
| 11 GRADATION | 11 | 0001 0011 11 | 11 1000 1110 0011 1000 1110 0011 1000 1110 0011 · · · |
| 12 GRADATION | 11 | 0000 0011 11 | 11 1000 1110 0011 1000 1110 0011 1000 1110 0011 · · · |
| 13 GRADATION | 11 | 0010 0101 11 | 11 1000 1110 0011 1000 1110 0011 1000 1110 0011 · · · |
| 14 GRADATION | 11 | 0000 0001 11 | 11 1000 1110 0011 1000 1110 0011 1000 1110 0011 · · · |
| 15 GRADATION | 11 | 0001 0101 11 | 11 1000 1110 0011 1000 1110 0011 1000 1110 0011 · · · |
| 16 GRADATION | 11 | 0000 0001 11 | 01 1011 0110 1101 1011 0110 1101 1011 0110 1101 · · · |
| 17 GRADATION | 11 | 0000 0101 11 | 01 1011 0110 1101 1011 0110 1101 1011 0110 1101 · · · |
| 18 GRADATION | 11 | 0000 0001 11 | 01 1011 0110 1101 1011 0110 1101 1011 0110 1101 · · · |
| 19 GRADATION | 11 | 0000 0010 11 | 01 1011 0110 1101 1011 0110 1101 1011 0110 1101 · · · |
| 20 GRADATION | 11 | 0000 0000 11 | 01 1011 0110 1101 1011 0110 1101 1011 0110 1101 · · · |
| 21 GRADATION | 11 | 0000 0001 01 | 00 1100 1100 1100 1100 1100 1100 1100 1100 1100 · · · |
| 22 GRADATION | 11 | 0000 0000 00 | 00 1100 1100 1100 1100 1100 1100 1100 1100 1100 · · · |
| 23 GRADATION | 11 | 0000 0000 10 | 00 1100 1100 1100 1100 1100 1100 1100 1100 1100 · · · |
| 24 GRADATION | 11 | 0000 0000 00 | 01 1111 0111 1111 1111 0111 1111 1111 0111 1111 · · · |
| 25 GRADATION | 11 | 0000 0000 01 | 00 1111 0011 1111 1111 0011 1111 1111 0011 1111 · · · |
| 26 GRADATION | 11 | 0000 0000 00 | 00 1111 0011 1111 1111 0011 1111 1111 0011 1111 · · · |
| 27 GRADATION | 11 | 0000 0000 00 | 10 0111 1001 1111 0111 1001 1111 0111 1001 1111 · · · |
| 28 GRADATION | 11 | 0000 0001 00 | 00 1011 0010 1111 1011 0010 1111 1011 0010 1111 · · · |
| 29 GRADATION | 11 | 0000 0000 00 | 00 0001 0000 0111 0001 0000 0111 0001 0000 0111 · · · |
| 30 GRADATION | 11 | 0000 0000 00 | 00 0101 0001 0111 0101 0001 0111 0101 0001 0111 · · · |
| 31 GRADATION | 11 | 0000 0000 00 | 00 0000 0000 0000 0000 0000 0000 0000 0000 0000 · · · |

FIG. 4

ELECTRO-OPTICAL DEVICE, DRIVING METHOD THEREFOR, AND ELECTRONIC APPARATUS

The entire disclosure of Japanese Patent Application. No. 2009-115522, filed May 12, 2009 is expressly incorporated by reference herein.

BACKGROUND

1. Technical Field

Some aspects according to the present invention relate to an electro-optical device, a driving method therefor, an electronic apparatus, and the like.

2. Related Art

In a liquid crystal device as a form of an electro-optical device, since temperature dependency is present in characteristics (response speed, etc.) of liquid crystal, a liquid crystal applied voltage necessary for representing the same gradation is different depending on temperature. Therefore, in the past, a data table indicating a correspondence relation between a gradation and a liquid crystal applied voltage necessary for representing the gradation is prepared in advance for each temperature. Gradation correction with respect to a temperature change is performed by selecting a liquid crystal applied voltage suitable for temperature detected by a temperature sensor set near a display area of the liquid crystal device from a data table corresponding to the temperature. Besides, as a method of gradation correction with respect to a temperature change, a method of adopting a structure mounted with a Peltier element in order to keep temperature constant or setting a fan to forcibly cool the liquid crystal device is adopted (see, for example, JP-A-2004-325496, JP-A-2005-215128, JP-A-2005-258465, and JP-A-2000-356976).

In the method of preparing a data table for each temperature in order to perform gradation correction with respect to a temperature change as explained above, a large-capacity memory or a large number of small-capacity memories are necessary. This leads to an increase in power consumption, a mounting area, and cost. Further, since plural data tables are prepared, adjusting time also increases. Therefore, the method is unsuitable for a reduction in size and cost.

On the other hand, in the method of using a Peltier element, since the Peltier element is expensive and power consumption increases, the method is unsuitable for a reduction in cost and power consumption. In the method of using a fan, it is necessary to increase the size of the fan itself in order to increase an air quantity. This causes an increase in cost and the size of a housing. Further, it is necessary to provide a function of suppressing occurrence of sound and dust involved in the rotation of the fan. Therefore, the method is unsuitable for a reduction in cost.

SUMMARY

An advantage of some aspects of the invention is to provide an electro-optical device that can perform gradation correction with respect to a temperature change without causing an increase in the size of the device and cost, a driving method for the electro-optical device, and an electronic apparatus.

According to an aspect of the invention, there is provided an electro-optical device including a temperature detecting unit that detects temperature, wherein the electro-optical device sets the number of sub-frames of plural sub-frames included in one frame according to the temperature detected by the temperature detecting unit and sets a luminance level of pixels in each of the plural sub-frames to at least a first level or a second level to perform gradation display.

With the electro-optical device having such a characteristic, it is possible to obtain an effect equivalent to an increase in response speed of an electro-optical material (e.g., liquid crystal) by increasing the number of sub-frames in one frame to reduce processing time for data, for example, when temperature near a display area is low. On the other hand, it is possible to obtain an effect equivalent to a reduction in the response speed of the electro-optical material by reducing the number of sub-frames in one frame (extending one sub-frame period) to increase the processing time for data when the temperature is high. In other words, it is possible to uniformalize the response time of the electro-optical material irrespectively of a temperature change by setting the number of sub-frames in one frame according to temperature.

Therefore, with the electro-optical device according to the aspect of the invention, it is unnecessary to use the lookup table or the Peltier element in the past. Therefore, it is possible to perform gradation correction with respect to a temperature change irrespectively of the temperature change without causing an increase in the size of the device and cost.

In the electro-optical device according to the aspect of the invention, it is desirable that the electro-optical device further includes a code generating unit that generates a digital code for designating a luminance level of the pixels equivalent to the number of sub-frames.

By adopting such a configuration, with a simple and high-speed circuit configuration, it is possible to set the number of sub-frames in one frame according to temperature and control the luminance level of the pixels in the sub-frames.

In the electro-optical device according to the aspect of the invention, it is desirable that the first level is equivalent to black display in which the luminance level of the pixels is 0 and the second level is the luminance level of the pixels other than 0.

By providing black display codes in the digital code, it is possible to reset an image between frames and realize improvement of moving image quality. By providing gradation keep codes in the digital code, it is possible to continue to keep a gradation of pixels and prevent deterioration in image quality even when the number of sub-frames in one frame increases.

In the electro-optical device according to the aspect of the invention, it is desirable that the code generating unit includes: a frame buffer that can store image data for at least two frames; and a code converting unit that converts the image data output from the frame buffer into the digital code, and the electro-optical device further includes: a system-clock generating unit that generates a system clock signal having a frequency corresponding to the temperature detected by the temperature detecting unit; a writing control unit that controls writing of the image data in the frame buffer on the basis of a dot clock signal, a vertical synchronization signal, and a horizontal synchronization signal input together with the image data; and a readout control unit that controls readout of the image data from the frame buffer on the basis of the system clock signal and the vertical synchronization signal and performs setting of the number of sub-frames and control of the luminance level of the pixels in each of the sub-frames based on the digital code.

By adopting such a configuration, with a single and high-speed circuit configuration, it is possible to realize generation of the digital code and control of the luminance level of the pixels in each of the sub-frames.

In the electro-optical device according to the aspect of the invention, it is desirable that the temperature detecting unit outputs a voltage signal having a level corresponding to a detection result of the temperature, and the system-clock generating unit is a voltage-controlled oscillator that generates a system clock signal having a frequency corresponding to the level of the voltage signal.

By using the voltage-controlled oscillator as the system-clock generating unit in this way, with a simple and inexpensive circuit configuration, it is possible to generate a system clock signal having a frequency corresponding to a level of a voltage signal (temperature) output from the temperature detecting unit.

A driving method for an electro-optical device according to another aspect of the invention includes: detecting temperature; and setting the number of sub-frames of plural sub-frames included in one frame according to the temperature and setting a luminance level of pixels in each of the plural sub-frames to at least a first level or a second level to perform gradation display.

With the driving method for an electro-optical device having such a characteristic, it is unnecessary to use the lookup table or the Peltier element in the past. Therefore, it is possible to perform gradation correction with respect to a temperature change irrespectively of the temperature change without causing an increase in the size of the device and cost.

An electronic apparatus according to still another aspect of the invention includes the electro-optical device explained above.

With the electronic apparatus having such a characteristic, since the electronic apparatus includes the electro-optical device that can perform gradation correction with respect to a temperature change with a small size and at low cost, it is possible to realize improvement of display quality and a reduction in size and cost.

BRIEF DESCRIPTION OF THE DRAWINGS

The invention will be described with reference to the accompanying drawings, wherein like numbers reference like elements.

FIG. 4 is a correspondence table showing relation between gradations and a digital code generated according to the gradation.

DESCRIPTION OF EXEMPLARY EMBODIMENTS

An embodiment of the invention is explained below with reference to the drawings.

Figure 1:
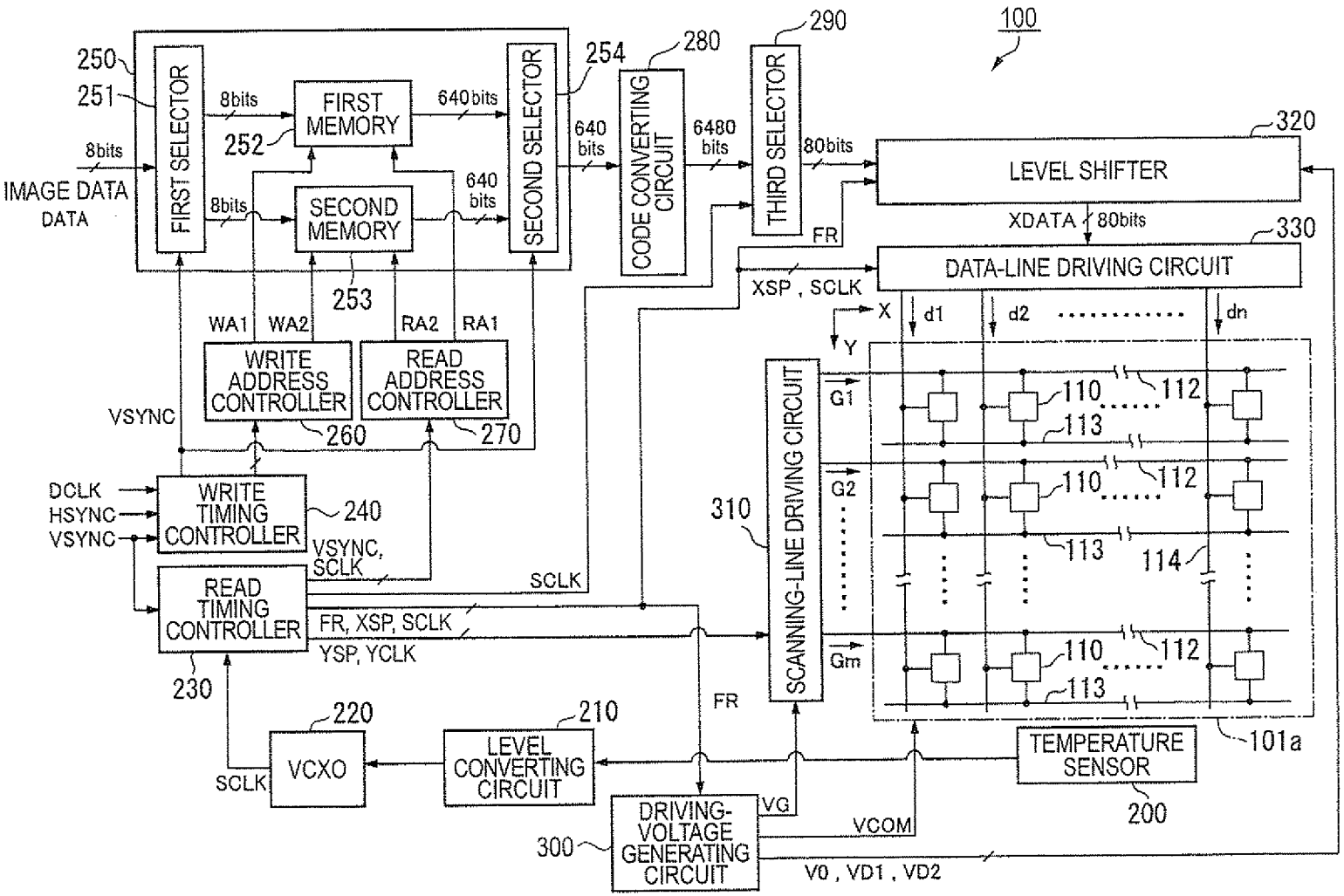
FIG. 1 is a block diagram of a liquid crystal device (an electro-optical device) according to an embodiment of the invention.

FIG. 1 is a block diagram showing an electro-optical device according to this embodiment. As the electro-optical apparatus according to this embodiment, a liquid crystal device 100 in which a device substrate and an opposed substrate are stuck to each other with a fixed gap kept therebetween and liquid crystal as an electro-optical material is held in the gap is illustrated and explained.

The liquid crystal device 100 according to this embodiment adopts, as a gradation display system, digital time division driving for dividing one frame into plural sub-frames and setting a luminance level of pixels in each of the sub-frames to at least a first level or a second level to perform gradation display. The liquid crystal device 100 adopts common inversion driving as an AC driving system. A display mode of the liquid crystal device 100 is normally white. The liquid crystal device 100 is explained as performing black display (the first level: the luminance level is 0) in a state in which voltage is applied to the pixels and performing white display (the second level: the luminance level is other than 0) in a state in which voltage is not applied to the pixels.

In such a liquid crystal device 100, a transparent substrate such as a glass substrate is used as the device substrate. A peripheral driving circuit and the like are formed on the device substrate together with a transistor that drives the pixels. On the other hand, in a display area 101*a* on the device substrate, m scanning lines 112 and m storage capacitor lines 113 are formed to extend in an X direction and n data lines 114 are formed to extend along a Y direction. Pixels 110 are arrayed in an m×n matrix shape to correspond to intersections of the scanning lines 112 and the data lines 114. In the following explanation of this embodiment, it is assumed that m is 480 and n is 720.

Figure 2:
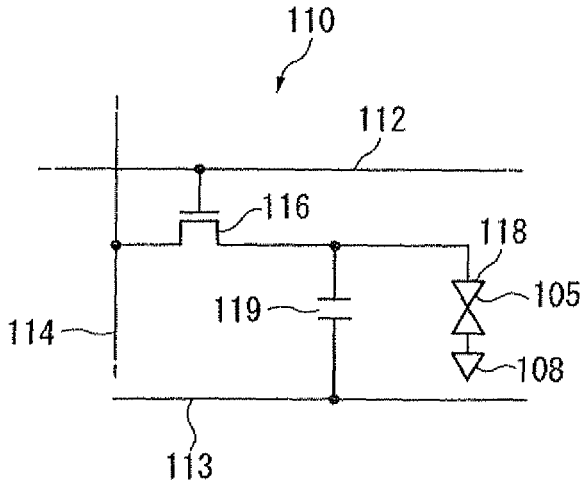
FIG. 2 is a detailed explanatory diagram concerning a pixel in the liquid crystal device according to the embodiment.

An example of a specific configuration of the pixel 110 is shown in FIG. 2. As shown in FIG. 2, the pixel 110 has a configuration in which a gate of a transistor (a MOS FET) 116 as switching means is connected to the scanning line 112, a source thereof is connected to the data line 114, and a drain thereof is connected to a pixel electrode 118 and liquid crystal 105 as an electro-optical material is held between the pixel electrode 118 and an opposed electrode (a common electrode) 108 to form a liquid crystal layer.

The opposed electrode 108 is a transparent electrode formed over the entire surface of the opposed substrate to be opposed to the pixel electrode 118. A storage capacitor 119 is formed between the pixel electrode 118 and the storage capacitor line 113. The storage capacitor 119 supplementarily accumulates charges in conjunction with the electrodes that hold the liquid crystal layer. A common voltage VCOM is supplied to the opposed electrode 108 and the storage capacitor line 113 from a driving-voltage generating circuit 300 explained later.

A scanning signal G1, G2, . . . , or Gm is supplied to each of the scanning lines 112 from a scanning-line driving circuit 310 explained later. The transistor 116 forming the pixel 110 connected to the scanning line 112 is turned on by the scanning signal G1, G2, . . . , or Gm. Consequently, a data signal d1, d2, . . . , or dn supplied to the data line 114 from a data-line driving circuit 330 explained later is supplied to the pixel electrode 118 and written in the liquid crystal 105 and the storage capacitor 119. Since the digital time division driving is adopted, the data signal d1, d2, . . . , or dn is a binary voltage corresponding to the first level (black) or the second level (white). A molecular orientation state of the liquid crystal 105 changes according to the voltage written in the pixel 110 in this way, i.e., a potential difference between the pixel electrode 118 and the opposed electrode 108 and modulation of illumination light is performed.

Referring back to FIG. 1, the electric configuration of the liquid crystal device 100 according to this embodiment is explained. As shown in FIG. 1, the liquid crystal device 100 according to this embodiment includes a temperature sensor 200, a level converting circuit 210, a VCXO (Voltage Controlled Crystal Oscillator) 220, a read timing controller 230, a write timing controller 240, a frame buffer 250, a write address controller 260, a read address controller 270, a code converting circuit 280, a third selector 290, the driving-voltage generating circuit 300, the scanning-line driving circuit 310, a level shifter 320, and the data-line driving circuit 330.

Among the components, the temperature sensor 200 is equivalent to the temperature detecting unit, the VCXO 220 is equivalent to the system-clock generating unit, the write timing controller 240 and the write address controller 260 are equivalent to the writing control unit, the read timing controller 230, the read address controller 270, the driving-voltage generating circuit 300, the scanning-line driving circuit 310, the level shifter 320, and the data-line driving circuit 330 are equivalent to the readout control unit, and the frame buffer 250, the code converting circuit 280, and the third selector 290 are equivalent to the code generating unit.

Image data DATA, a dot clock signal DCLK, a vertical synchronization signal VSYNC, and a horizontal synchronization signal HSYNC are input to such a liquid crystal device 100 from a not-shown external control device. The image data DATA is data indicating a gradation that should be displayed in each of the pixels 110. In the following explanation, it is assumed that the number of bits of the image data DATA is eight (i.e., 256 gradations). As it is well known, the dot clock signal DCLK is a signal for defining transfer speed of the image data DATA (transfer timing of the image data DATA for one pixel). The vertical synchronization signal VSYNC is a signal for defining start timing of one frame. The horizontal synchronization signal HSYNC is a signal for defining start timing of one horizontal scanning period.

The temperature sensor 200 includes a temperature detecting circuit employing a thermistor. The temperature sensor 200 detects temperature near the display area 101*a* and outputs an analog voltage signal having a level corresponding to a detection result of the temperature to the level converting circuit 210. The level converting circuit 210 adjusts the level of the analog voltage signal input from the temperature sensor 200 to be within a range of voltage that can be input to the VCXO 220 explained later. The level converting circuit 210 outputs the analog voltage signal after the level adjustment to the VCXO 220.

The VCXO 220 is a voltage-controlled crystal oscillator. The VCXO 220 generates a system clock signal SCLK having a frequency corresponding to the level of the analog voltage signal (i.e., temperature) input from the level converting circuit 210 and outputs the system clock signal SCLK to the read timing controller 230. A frequency $f_{SCLK}$ of the system clock signal SCLK is represented by the following Formula (1). In the following Formula (1), $f_{FM}$ represents a frame frequency (60 Hz), k represents the number of sub-frames (a minimum $k_{min}$ to a maximum $k_{max}$) in one frame, m represents the number of scanning lines (480), n represents the number of data lines (720), and N represents the number of expanded phases (e.g. "80").

$$f_{SCLK}=f_{FM}\times k\times m\times n/N \quad (1)$$

Specifically, in the liquid crystal device 100 according to this embodiment, in order to realize a function of changing the number of sub-frames k in one frame in a range of the minimum $k_{min}$ (e.g., "20") to the maximum $k_{max}$ (e.g., "81") according to temperature near the display area 101*a*, the frequency $f_{SCLK}$ of the system clock signal SCLK is linearly changed in a range of 5.18 MHz (k=20) to 21 MHz (k=81) according to the level of the analog voltage signal (temperature) by using the VCXO 220.

Phase expansion is a method for lowering a writing frequency of a data signal (i.e., the frequency $f_{SCLK}$ of the system clock signal SCLK) in the pixel 110. When the number of expanded phases N is "80", the data signal is sequentially written in the seven hundred twenty pixels 110 connected to one scanning line 112 in a unit of eighty pixels. In other words, since writing operation only has to be performed nine times in one horizontal scanning period (when the phase expansion is not performed, seven hundred twenty times), the writing frequency ($f_{SCLK}$) can be lowered.

The read timing controller 230 generates, on the basis of the system clock signal SCLK input from the VCXO 220 and the vertical synchronization signal VSYNC input from the outside, a polarity inverting signal FR, a scanning start pulse YSP, a scanning transfer clock YCLK, and a data transfer start pulse XSP.

The polarity inverting signal FR is a signal for defining a polarity inversion period for writing voltage of the pixel 110 (in other words, a signal for defining a common inversion operation period). In this embodiment, the polarity inversion period is determined such that polarity is inverted once in one frame. In other words, the polarity inversion signal FR is a pulse signal, a level of which changes once in one frame. In this embodiment, voltage having positive polarity is written in the pixel 110 when the polarity inverting signal FR is at a high level. Voltage having negative polarity is written in the pixel 110 when the polarity inverting signal FR is at a low level.

The scanning start pulse YSP is a signal for defining start timing of the sub-frames. The scanning start pulse YSP is generated by frequency-dividing the system clock signal SCLK. A frequency $f_{YSP}$ of the scanning start pulse YSP is represented by the following Formula (2):

$$f_{YSP}=f_{FM}\times k \quad (2)$$

Specifically, the frequency $f_{YSP}$ of the scanning start pulse YSP linearly changes in a range of 1.2 kHz (k=20) to 4.86 kHz (k=81) according to temperature near the display area 101*a*.

The scanning transfer clock YCLK is a signal for defining scanning speed on a scanning side (a Y side) (in other words, a signal for defining output timing of the scanning signals G1, G2, . . . , and Gm). The scanning transfer clock YCLK is generated by frequency-dividing the system clock signal SCLK. A frequency $f_{YCLK}$ of the scanning transfer clock YCLK is represented by the following Formula (3):

$$f_{YCLK}=f_{YSP}\times m/2 \quad (3)$$

Specifically, the frequency $f_{YCLK}$ of the scanning transfer clock YCLK linearly changes in a range of 288 kHz (k=20) to 1.16 MHz (k=81) according to temperature near the display area 101*a*.

The data transfer start pulse XSP is a signal for defining start timing of one horizontal scanning period. The data transfer start pulse XSP is generated by frequency-dividing the system clock signal SCLK. A frequency $f_{XSP}$ of the data transfer start pulse XSP is represented by the following Formula (4):

$$f_{XSP}=f_{YSP}\times m \quad (4)$$

Specifically, the frequency $f_{XSP}$ of the data transfer start pulse XSP linearly changes in a range of 576 kHz (k=20) to 2.33 MHz (k=81) according to temperature near the display area 101*a*.

The read timing controller 230 outputs the vertical synchronization signal VSYNC to the read address controller 270, outputs the system clock signal SCLK to the read address controller 270, the third selector 290, and the data-line driving circuit 330, outputs the polarity inverting signal. FR to the driving-voltage generating circuit 300 and the level shifter 320, outputs the scanning start pulse YSP and the scanning transfer clock YCLK to the scanning-line driving circuit 310, and outputs the data transfer start pulse XSP to the data-line driving circuit 330.

Among the dot clock signal DCLK, the vertical synchronization signal VSYNC, and the horizontal synchronization signal HSYNC input from the external control device, the write timing controller 240 outputs the vertical synchronization signal VSYNC to the frame buffer 250 (specifically, a first selector 251 and a second selector 254) and outputs the dot clock signal DCLK, the vertical synchronization signal VSYNC and the horizontal synchronization signal HSYNC to the write address controller 260.

The frame buffer 250 includes memories that can store the image data DATA, which is input from the external control device, for two frames. The frame buffer 250 enables continuous image display by alternately switching write-only memory and a read-only memory for each frame. Such a frame buffer 250 includes the first selector 251, a first memory 252, a second memory 253, and the second selector 254.

The first selector 251 alternately switches memories (the first memory 252 and the second memory 253) as an output destination of the image data DATA in synchronization with the vertical synchronization signal VSYNC input from the write timing controller 240. Specifically, one of the first memory 252 and the second memory 253 selected as the output designation of the image data DATA is a write-only memory and the other is a read-only memory. The write-only memory and the read-only memory are alternately switched for each frame.

The first memory 252 is a volatile memory such as a RAM (Random Access Memory) having a capacity enough for storing the image data DATA for one frame. When the first memory 252 is the write-only memory, the image data DATA, is sequentially stored (written) in an address indicated by a first write address signal WA1 input from the write address controller 260. On the other hand, when the first memory 252 is the read-only memory, the image data DATA stored in an address indicated by a first read address signal RA1 input from the read address controller 270 is sequentially read out and output to the second selector 254.

The second memory 253 is a volatile memory such as a RAM having a capacity enough for storing the image data DATA for one frame. When the second memory 253 is the write-only memory, the image data DATA is sequentially stored in an address indicated by a second write address signal WA2 input from the write address controller 260. On the other hand, when the second memory 253 is the read-only memory, the image data DATA stored in an address indicated by a second read address signal RA2 input from the read address controller 270 is sequentially read out and output to the second selector 254.

As explained above, when the number of expanded phases N is "80", it is necessary to simultaneously write data signals in the eighty pixels 110 in one write operation. Therefore, the number of bits of image data output from the first memory 252 and the second memory 253 is a number equivalent to the eighty pixels, i.e., 80×8 bits=640 bits.

The second selector 254 alternately switches memories (the first memory 252 and the second memory 253) as an input source of the image data DATA in synchronization with the vertical synchronization signal VSYNC input from the write timing controller 240. Specifically, for example, when the first selector 251 outputs the image data DATA to the first memory 252, the first memory 252 is the write-only memory and the second memory 253 is the read-only memory. Therefore, the second selector 254 switches the second memory 253 as the input source of the image data DATA and outputs the image data DATA input from the second memory 253 to the code converting circuit 280.

The write address controller 260 specifies, on the basis of the dot clock signal DCLK, the vertical synchronization signal VSYNC, and the horizontal synchronization signal HSYNC input from the write timing controller 240, a position on the display area 101*a* (a position of the pixel 110) for the image data DATA sent from the external control device. The write address controller 260 generates, on the basis of a result of the specification, a write address for storing the image data DATA in the first memory 252 or the second memory 253.

The write address controller 260 alternately switches memories (the first memory 252 and the second memory 253) as an output destination of the write address in synchronization with the vertical synchronization signal VSYNC. Specifically, for example, when the first selector 251 outputs the image data DATA to the first memory 252, the first memory 252 is the write-only memory and the second memory 253 is the read-only memory. Therefore, the write address controller 260 switches the output destination of the write address to the first memory 252 and outputs the generated write address to the first memory 252 as the first write address signal WA1.

On the other hand, for example, when the first selector 251 outputs the image data DATA to the second memory 253, the first memory 252 is the read-only memory and the second memory 253 is the write-only memory. Therefore, the write address controller 260 switches the output destination of the write address to the second memory 253 and outputs the generated write address to the second memory 253 as the second write address signal WA2.

The write address controller 260 resets the write address in synchronization with the vertical synchronization signal VSYNC and counts up the write address in synchronization with the dot clock signal DCLK to thereby control writing of the image data DATA corresponding to the pixels in one frame.

The read address controller 270 generates, on the basis of the system clock signal SCLK and the vertical synchronization signal VSYNC input from the read timing controller 230, a read address for reading out the image data DATA from the first memory 252 or the second memory 253. The read address controller 270 alternately switches memories (the first memory 252 and the second memory 253) as an output destination of the read address in synchronization with the vertical synchronization signal VSYNC.

Specifically, for example, when the first selector 251 outputs the image data DATA to the second memory 253, the first memory 252 is the read-only memory and the second memory 253 is the write-only memory. Therefore, the read address controller 270 switches the output destination of the read address to the first memory 252 and outputs the generated read address to the first memory 252 as the first read address signal RA1.

On the other hand, for example, when the first selector 251 outputs the image data DATA to the first memory 252, the first memory 252 is the write-only memory and the second memory 253 is the read-only memory. Therefore, the read address controller 270 switches the output destination of the read address to the second memory 253 and outputs the generated write address to the second memory 253 as the second read address signal RA2.

The read address controller 270 resets the read address in synchronization with the vertical synchronization signal VSYNC and counts up the read address in synchronization with the system clock signal SCLK to thereby control readout of the image data DATA corresponding to the pixels in one frame.

The code converting circuit 280 converts, in a unit of one pixel, the image data DATA (640 bits) input from the second selector 254 of the frame buffer 250 into a digital code for designating a luminance level (the first level (black) or the second level (white)) of the pixels 110 in each of the sub-frames and outputs the digital code to the third selector 290. As explained above, in the liquid crystal device 100 according to this embodiment, the number of sub-frames k in one frame is set according to temperature near the display area 101*a* (a temperature detection result of the temperature sensor 200). Therefore, it is necessary to convert the image data DATA into a digital code applicable to the maximum $k_{max}$ of the number of sub-frames.

Specifically, when the number of sub-frames k in one frame is set in a range of 20 to 81 according to temperature ($k_{max}$81), the code converting circuit 280 converts the image data DATA input from the second selector 254 into a digital code applicable to eighty-one sub-frames in a unit of one pixel.

Figure 3:
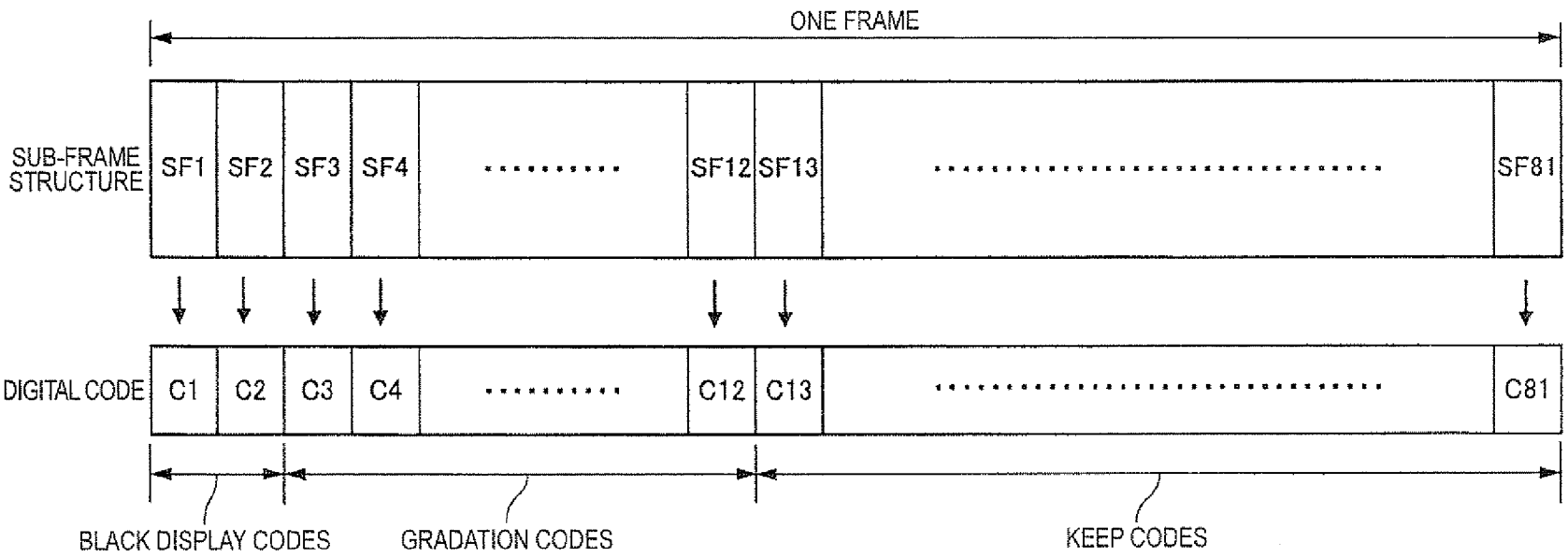
FIG. 3 is an explanatory diagram concerning a correspondence relation between a sub-frame configuration and a digital code in the liquid crystal device according to the embodiment.

FIG. 3 represents a correspondence relation between a sub-frame configuration in one frame in the case of $k_{max}$=81 and a digital code for one pixel. As shown in FIG. 3, the code converting circuit 280 converts the image data DATA (8 bit data) for one pixel into a digital code (an 81-bit data) including a string of eighty-one codes, i.e., a code C1 (when the first level (black) is designated as the luminance level, "1" and, when the second level (white) is designated, "0") corresponding to a first sub-frame SF1, a code C2 corresponding to a second sub-frame SF2, . . . , and a code C81 corresponding to an eighty-first sub-frame SF81.

In such a digital code, the codes C1 and C2 corresponding to the first and second sub-frames SF1 and SF2 are black display codes necessary for performing black display. The codes C3 to C12 corresponding to the third to twelfth sub-frames SF3 to SF12 are gradation codes necessary for performing gradation display. The codes C13 to C81 corresponding to the remaining sub-frames SF13 to SF81 are keep codes (gradation keeping codes) necessary for keeping a gradation.

By providing the black display codes in the digital code in this way, it is possible to reset an image between frames and realize improvement of moving image quality. By providing the keep codes in the digital code, it is possible to continue to keep a gradation of pixels and prevent deterioration in image quality even when the number of sub-frames k in one frame increases.

FIG. 4 represents a correspondence relation between gradations (as an example, 0 to 31 gradations) and the black display codes, the gradation codes, and the keep codes. As shown in FIG. 4, the black display codes (C1 and C2) are set to "1" irrespectively of the gradations. The gradation codes (C3 to C12) are set to values corresponding to the respective gradations. The keep codes (C13 to C81) are set to values for keeping the respective gradations and, since the number of codes is large, are repetitive codes.

Specifically, the code converting circuit 280 sets, on the basis of the correspondence table shown in FIG. 4, values of the black display codes, the gradation codes, and the keep codes corresponding to gradations indicated by the image data DATA for one pixel to thereby generate a digital code corresponding to the one pixel. The image data DATA input from the second selector 254 to the code converting circuit 280 is 640-bit data indicating gradations for eighty pixels. Therefore, the number of bits of the digital code output from the code converting circuit 280 to the third selector 290 is a number equivalent to the eighty pixels, i.e., 80 pixels×81 bits=6480 bits.

Such a function of the code converting circuit 280 can be realized by using, for example, a ROM (Read Only Memory). Specifically, if the gradations are set as addresses and values of the black display codes, the gradation codes, and the keep codes corresponding to the addresses (the gradations) are stored in the ROM in advance, by inputting the image data DATA (data indicating a gradation), it is possible to read out the values of the black display codes, the gradation codes, and the keep codes corresponding to the gradation. It is possible to convert the image data DATA into a digital code with a high-speed and simple circuit configuration.

The third selector 290 collectively selects, in synchronization with the system clock signal SCLK input from the read timing controller 230, codes for eighty pixels in order from the first code C1 among the codes C1 to C81 included in digital codes (6480 bits) input from the code converting circuit 280, i.e., each of digital codes for the eighty pixels and simultaneously outputs the codes to the level shifter 320. In other words, the number of data bits output from the third selector 290 to the level shifter 320 is eighty.

The driving-voltage generating circuit 300 generates a voltage VG (a gate-on voltage of the transistor 116) of the scanning signals G1, G2, . . . , and Gm and outputs the voltage VG to the scanning-line driving circuit 310. The driving-voltage generating circuit 300 generates a reference voltage V0, a maximum voltage VD1 (a black voltage in the case of positive polarity), and a minimum voltage VD2 (a black voltage in the case of negative polarity) of the data signals d1, d2, . . . , and do and outputs the voltages to the level shifter 320. The driving-voltage generating circuit 300 generates a common voltage VCOM and outputs the common voltage VCOM to the opposed electrode 108 and the storage capacitor line 113 provided in the display area 101*a*. The maximum voltage VD1 and the minimum voltage VD2 are set to values symmetrical to each other with respect to the reference voltage V0.

Further, the driving-voltage generating circuit 300 has a function of inverting the polarity of the common voltage VCOM with respect to the reference voltage V0 according to a level of the polarity inverting signal FR input from the read timing controller 230. Specifically, when the polarity inverting signal FR is at the high level (positive polarity), the common voltage VCOM has a value on the negative pole side (a minimum value) with respect to the reference voltage V0. When the polarity inverting signal FR is at the low level (negative polarity), the common voltage VCOM has a value on the positive pole side (a maximum value) with respect to the reference voltage V0. The maximum value of the common voltage VCOM is set to be equal to the maximum voltage VD1 of the data signal and the minimum value of the common voltage VCOM is set to be equal to the minimum voltage VD2 of the data signal.

The scanning-line driving circuit 310 grasps start timing of each of the sub-frames from the scanning start pulse YSP and sequentially outputs the scanning signals G1, G2, G3, . . . , and Gm having the voltage VG to each of the scanning lines 112 in synchronization with the scanning transfer clock YCLK.

The level shifter 320 shifts, on the basis of values of codes Ci (i represents integers 1 to 81) for eighty pixels input from the third selector 290 and a level of the polarity inverting signal FR, a voltage level of each of the codes Ci to a voltage level that should be supplied to the pixels 110 and outputs the codes Ci for the eighty pixels after the voltage level shift to the data-line driving circuit 330 as display data XDATA (80 bits).

Specifically, when the code Ci is "1" for designating the first level and the polarity inverting signal FR is at the high level (positive polarity), the level shifter 320 shifts the voltage level of the code Ci to the maximum voltage VD1. When the code Ci is "1" for designating the first level and the polarity inverting signal FR is at the low level (negative polarity), the level shifter 320 shifts the voltage level of the code Ci to the minimum voltage VD2.

On the other hand, when the code Ci is "0" for designating the second level and the polarity inverting signal FR is at the high level (positive polarity), the level shifter 320 shifts the voltage level of the code Ci to the minimum voltage VD2. When the code Ci is "0" for designating the second level and the polarity inverting signal FR is at the low level (negative polarity), the level shifter 320 shifts the voltage level of the code Ci to the maximum voltage VD1.

According to such voltage level shift operation by the level shifter 320 and the common voltage inverting operation by the driving-voltage generating circuit 300, voltage having positive polarity with respect to the common voltage VCOM is written in the pixels 110 in a period in which the polarity inverting signal FR is at the high level. Voltage having negative polarity with respect to the common voltage VCOM is written in the pixels 110 in a period in which the polarity inverting signal FR is at the low level.

The data-line driving circuit 330 grasps start timing of one horizontal scanning period from the data transfer start pulse XSP and simultaneously outputs the display data XDATA (80 bits) to the eighty data lines 114 as data signals for the eighty pixels in synchronization with the system clock SCLK. The data-line driving circuit 330 repeats the output operation for the data signal for the eighty pixels nine times while shifting the data lines 114 in a unit of eighty pixels in synchronization with the system clock SCLK to thereby complete output operation for data signals for seven hundred twenty pixels in one horizontal scanning period.

Figure 5A:
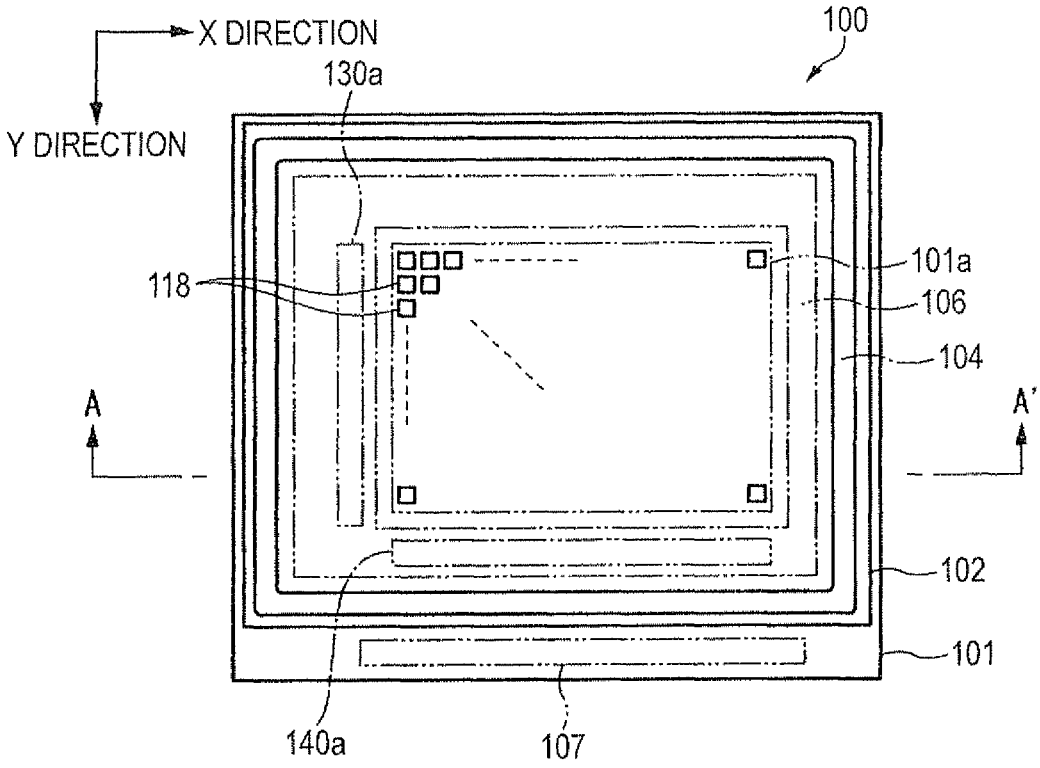
FIGS. 5A and 5B are overall diagrams of the liquid crystal device according to the embodiment.
Figure 5B:
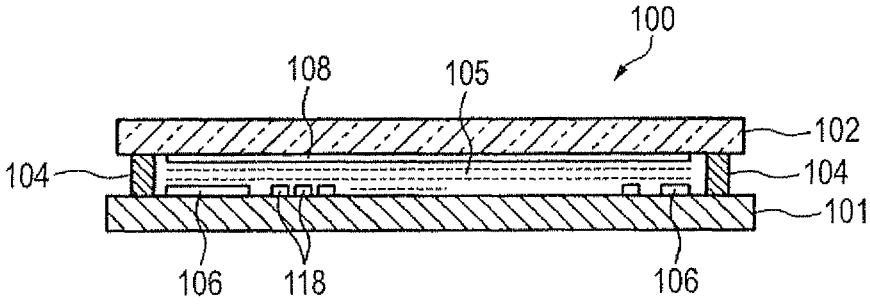

The overall configuration of the liquid crystal device 100 is explained below with reference to FIGS. 5A and 5B. FIG. 5A is a plan view showing the overall configuration of the liquid crystal device 100. FIG. 5B is an arrow sectional view taken along A-A' in FIG. 5A. As shown in these figures, in the liquid crystal device 100, a device substrate 101 on which the pixel electrode 118 and the like are formed and an opposed substrate 102 on which the opposed electrode 108 and the like are formed are stuck to each other with a fixed gap kept therebetween by a seal material 104. The liquid crystal 105 as an electro-optical material is held in the gap. Actually, there is a cutout portion in the seal material 104. After the liquid crystal 105 is filled via the cutout portion, the cutout portion is sealed by a sealing material. However, the cutout portion is not shown in the figures.

The opposed substrate 102 is a transparent substrate made of glass or the like. In the above explanation, the device substrate 101 is made of the transparent substrate. However, in the case of a reflective liquid crystal device, the device substrate 101 can be a semiconductor substrate. In this case, since the semiconductor substrate is opaque, the pixel electrode 118 is formed of reflective metal such as aluminum. On the device substrate 101, a light blocking film 106 is provided in an area on the inner side of the seal material 104 and on the outer side of the display area 101*a*. In the area where the light blocking film 106 is formed, the scanning-line driving circuit 310 is formed in an area 130*a* and the level shifter 320 and the data-line driving circuit 330 are formed in an area 140*a*.

Specifically, the light blocking film 106 prevents light from being made incident on the driving circuits formed in this area. The common voltage VCOM is applied to the light blocking film 106 together with the opposed electrode 108. On the device substrate 101, plural connection terminals are formed in an area 107 on the outer side of the area 140*a*, where the data-line driving circuit 330 is formed, and separated from the area 140*a* by the seal material 104. Control signals, power supply, and the like from the outside are input to the connection terminals.

On the other hand, electric conduction of the opposed electrode 108 on the opposed substrate 102 to the light blocking film 106 and the connection terminals on the device substrate 101 is realized by a conduction material (not shown) provided at least in one place among the four corners in substrate sticking portions. Specifically, the common voltage VCOM is applied to the light blocking film 106 via the connection terminals provided on the device substrate 101 and is applied to the opposed electrode 108 via the conduction material.

Besides, on the opposed substrate 102, according to an application of the liquid crystal device 100, for example, when the liquid crystal device 100 is a direct view type, first, color filers arrayed in a stripe shape, a mosaic shape, a triangle shape, or the like are provided and, second, a light blocking film (black matrix) made of a metal material, resin, or the like is provided. In the case of an application to color light modulation, for example, when the liquid crystal device 100 is used as a light valve of a projector explained later, the color filter is not formed. In the case of the direct view type, a light that irradiates light on the liquid crystal device 100 from the opposed substrate 102 side or the device substrate 101 side is provided when necessary.

In addition, on electrode forming surfaces of the device substrate 101 and the opposed substrate 102, orientation films (not shown) or the like respectively subjected to rubbing treatment in predetermined directions are provided to define an orientation direction of liquid crystal molecules in a state in which voltage is not applied. On the other hand, on the opposed substrate 101 side, a polarizer (not shown) corresponding to the orientation direction is provided. However, if polymer-dispersed liquid crystal obtained by dispersing liquid crystal in a polymer as fine particles is used as the liquid crystal 105, the orientation films, the polarizer, and the like are unnecessary. As a result, light use efficiency is improved. Therefore, this is advantageous in terms of an increase in luminance, a reduction in power consumption, and the like.

Figure 6:
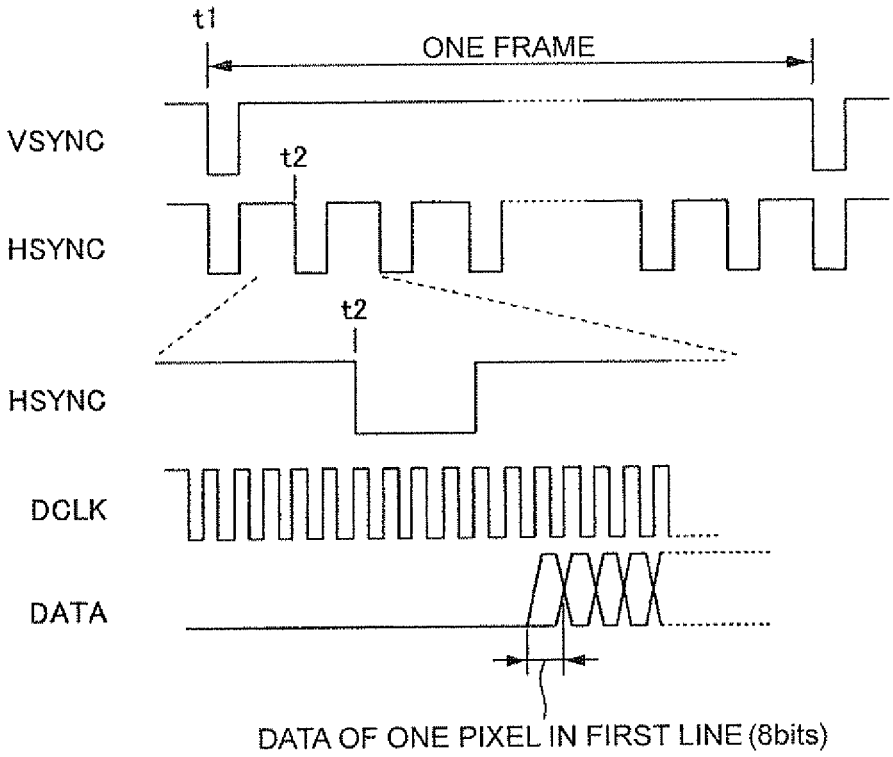
FIG. 6 is a first timing chart showing the operation of the liquid crystal device according to the embodiment.

The operation of the liquid crystal device 100 according to this embodiment configured as explained above is explained with reference to timing charts shown in FIGS. 6 and 7. FIG. 6 is a timing chart showing a temporal correspondence relation among the vertical synchronization signal VSYNC, the horizontal synchronization signal HSYNC, the dot clock signal DCLK, and the image data DATA.

As shown in FIG. 6, time t1 is time when a falling edge of the vertical synchronization signal VSYNC occurs, i.e., start timing of one frame. At time t1, the first selector 251 of the frame buffer 250 switches the memory as the output destination of the image data DATA in synchronization with the falling edge of the vertical synchronization signal VSYNC. For example, when the memory selected as the output destination of the image data DATA is the first memory 252 in the last frame, the second memory 253 is selected as the output destination of the image data DATA in the present frame. In other words, in the present frame, the first memory 252 is the read-only memory and the second memory 253 is the write-only memory. The image data DATA input from the external control device is output to the second memory 253 by the first selector 251.

The write address controller 260 switches the memory as the output destination of the write address in synchronization with the falling edge of the vertical synchronization signal VSYNC. As explained above, since the second memory 253 is the write-only memory in the present frame, the second memory 253 is selected as the output destination of the write address. The write address controller 260 resets the write address in synchronization with the falling edge of the vertical synchronization signal VSYNC and counts up the write address in synchronization with the dot clock signal DCLK to thereby generate a write address of the image data DATA corresponding to pixels in one frame. The write address controller 260 outputs the write address to the second memory 253 as the second write address signal WA2.

With such operation, for example, as shown in FIG. 6, when time t2 is time when a falling edge of the horizontal synchronization signal HSYNC occurs, i.e., start timing of a horizontal scanning period in a first line, the image data DATA for seven hundred twenty pixels in the first line is sequentially stored in the second memory 253 in a unit of one pixel. This operation is repeated up to the four hundred eighth line, whereby the image data DATA for the present one frame (720×480 pixels) is stored in the second memory 253.

On the other hand, the read address controller 270 switches the memory as the output destination of the read address in synchronization with the falling edge of the vertical synchronization signal VSYNC. As explained above, since the first memory 252 is the read-only memory in the present frame, the first memory 252 is selected as the output destination of the read address. The read address controller 270 resets the read address in synchronization with the falling edge of the vertical synchronization signal VSYNC and counts up the read address in synchronization with the dot clock signal DCLK to thereby generate a read address of the image data DATA corresponding to pixels in one frame. The read address controller 270 outputs the read address to the first memory 252 as the first read address signal RA1.

With such operation, in parallel to the operation for writing the image data DATA of the present frame in the second memory 253, the image data DATA stored in the last frame is read out from the first memory 252 and the image data DATA (640 bits) for eighty pixels is sequentially output to the second selector 254. The second selector 254 has selected the first memory 252 as the input source of the image data DATA in synchronization of the falling edge of the vertical synchronization signal VSYNC. The second selector 254 outputs the image data DATA for the eighty pixels input from the first memory 252 as explained above to the code converting circuit 280.

The code converting circuit 280 sets, on the basis of the correspondence table shown in FIG. 4, for each one pixel of the image data DATA input from the second selector 254, values of the black display codes, the gradation codes, and the keep codes corresponding to a gradation indicated by the image data DATA for the one pixel to generate digital code corresponding to the one pixel. The code converting circuit 280 simultaneously outputs digital codes for the eighty pixels to the third selector 290.

The system clock signal SCLK having the frequency $f_{SCLK}$ corresponding to a temperature detection result of the display area 101*a* by the temperature sensor 200 is output from the VCXO 220 to the read timing controller 230. As explained above, the frequency $f_{SLCK}$ of the system clock signal SCLK linearly changes in the range of 5.18 MHz (the number of sub-frames k=20) to 21 MHz (the number of sub-frames k=81) according to a level of an analog voltage signal (temperature) output from the level converting circuit 210.

The read timing controller 230 generates the polarity inverting signal FR, the scanning start pulse YSP, the scanning transfer clock YCLK, and the data transfer start pulse XSP on the basis of the system clock signal SCLK and the vertical synchronization signal VSYNC. FIG. 7 is a timing chart showing a temporal correspondence relation among the vertical synchronization signal VSYNC, the scanning start pulse YSP, the scanning signals G1, G2, . . . , and Gm output from the scanning-line driving circuit 310, the scanning transfer clock YCLK, the data transfer start pulse XSP, the system clock signal SCLK, and the display data XDATA output from the level shifter 320.

As explained above, the frequency $f_{YSP}$ the scanning start pulse YSP linearly changes in the range of 1.2 kHz (the number of sub-frames k=20) to 4.86 kHz (the number of sub-frames k=81) according to temperature near the display area 101*a*. Since the scanning start pulse YSP is a signal for defining start timing of each of the sub-frames, the change in the frequency $f_{YSP}$ means that the number of sub-frames k in one frame changes according to the temperature near the display area 101*a*. In FIG. 7, time t3 indicates start timing of the first sub-frame SF1, time t4 indicates start timing of the second sub-frame SF2, and time tk indicates start timing of a kth sub-frame SFk (k changes according to temperature).

The frequency $f_{YCLK}$ of the scanning transfer clock YCLK linearly changes in the range of 288 kHz (the number of sub-frames k=20) to 1.16 MHz (the number of sub-frames k=81) according to temperature near the display area 101*a*. The frequency $f_{XSP}$ of the data transfer start pulse XSP linearly changes in the range of 576 kHz (the number of sub-frames k=20) to 2.33 MHz (the number of sub-frames k=81) according to the temperature near the display area 101*a*.

Figure 7:
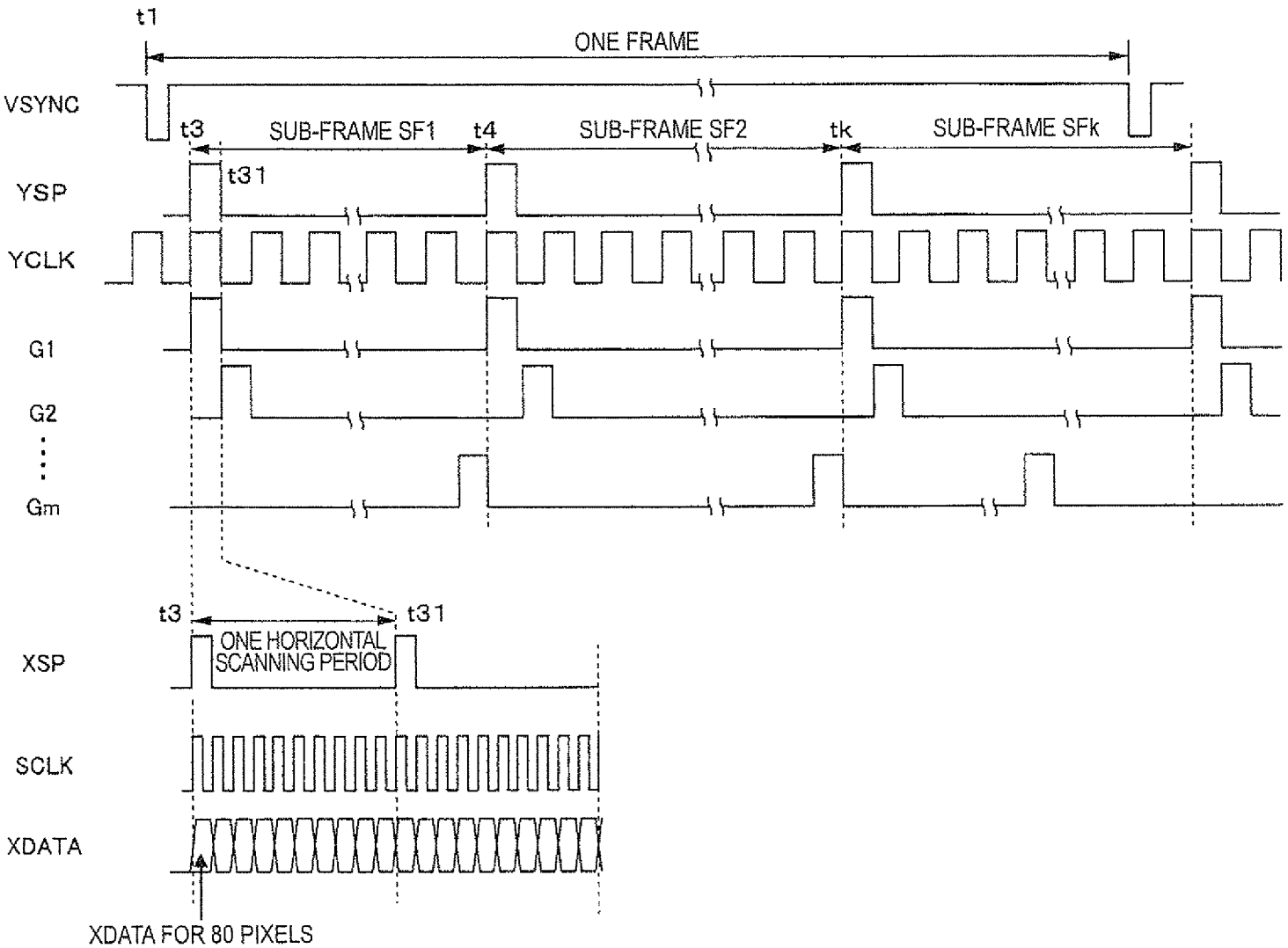
FIG. 7 is a second timing chart showing the operation of the liquid crystal device according to the embodiment.

In FIG. 7, when attention is paid to time t3 (the start timing of the first sub-frame SF1), the third selector 290 collectively selects, in synchronization with a rising edge of the system clock signal SCLK, from digital codes input from the code converting circuit 280, the codes C1 for eighty pixels corresponding to the first sub-frame SF1 among the codes C1 to C81 included in digital codes connected to the first scanning line 114 in the Y direction and respectively corresponding to the first to eightieth pixels 110 in the X direction and simultaneously outputs the codes C1 to the level shifter 320.

The level shifter 320 shifts, on the basis of values of the codes C1 for the eighty pixels input from the third selector 290 and a level of the polarity inverting signal FR, a voltage level of each of the codes C1 to a voltage level that should be supplied to the pixels 110 and outputs the codes C1 for the eighty pixels after the voltage level shift to the data-line driving circuit 330 as the display data XDATA (80 bits). For example, when the code C1 is "1" for designating the first level (black) and the polarity inverting signal FR is at the high level (positive polarity), the voltage level of the code C1 is shifted to the maximum voltage VD1 (at this point, the common voltage VCOM generated by the driving-voltage generating circuit 300 has a value on the negative pole side (a minimum value) with respect to the reference voltage V0).

On the other hand, the scanning-line driving circuit 310 grasps start timing of the first sub-frame SF1 according to a rising edge at time t3 of the scanning start pulse YSP and outputs the scanning signal G1 having the voltage VG to the first scanning line 112 in the Y direction in synchronization with a rising edge of the scanning transfer clock YCLK. Consequently, the transistors 116 in the seven hundred twenty pixels 110 connected to the first scanning line 112 in the Y direction are turned on.

The data-line driving circuit 330 grasps start timing of a first horizontal scanning period according to a rising edge at time t3 of the data transfer start pulse XSP and outputs, in synchronization with the rising edge of the system clock SCLK, the display data XDATA (80 bits) to the eighty data lines 114, i.e., the first to eightieth data lines 114 in the X direction as data signals d1, d2, . . . , and d80 for the eighty pixels. Consequently, black/white voltage corresponding to the first sub-frame SF1 is written in the first to eightieth pixels 110 connected to the first scanning line 112 in the Y direction.

Subsequently, when a rising edge of the next system clock SCLK occurs, the third selector 290 collectively selects, from digital codes input from the code converting circuit 280, the codes C1 for eighty pixels among the codes C1 to C81 included in digital codes respectively corresponding to the eighty first to one hundred sixtieth pixels 110 in the X direction and simultaneously outputs the codes C1 to the level shifter 320. The level shifter 320 outputs the codes C1 for the eighty pixels after the voltage level shift to the data-line driving circuit 330 as the next display data XDATA (80 bits).

The data-line driving circuit 330 outputs, in synchronization with the rising edge of the system clock SCLK, the display data XDATA (80 bits) to the eighty data lines 114, i.e., the eighty-first to one hundred sixtieth data lines 114 as data signals d81, d82, . . . , and d160 for the next eighty pixels. Consequently, black/white voltage corresponding to the first sub-frame SF1 is written in the eighty-first to one hundred sixtieth pixels 110 connected to the first scanning line 112 in the Y direction.

The operation explained above is repeated nine times every time the rising edge of the system clock SCLK occurs, whereby the black/white voltage corresponding to the first sub-frame SF1 is written in all the seven hundred twenty pixels 110 connected to the first scanning line 112 in the Y direction.

Subsequently, the scanning-line driving circuit 310 outputs, in synchronization with a falling edge at time t31 of the scanning transfer clock YCLK, the scanning signal G2 having the voltage VG to the second scanning line 112 in the Y direction. Consequently, the transistors 116 in the seven hundred twenty pixels 110 connected to the second scanning line 112 in the Y direction are turned on.

The third selector 290 collectively selects, in synchronization with a rising edge at time t31 of the system clock signal SCLK, from digital codes input from the code converting circuit 280, the codes C1 for eighty pixels corresponding to the first sub-frame SF1 among the codes C1 to C81 included in digital codes connected to the second scanning line 114 in the Y direction and respectively corresponding to the first to eightieth pixels 110 in the X direction and simultaneously outputs the codes C1 to the level shifter 320. The level shifter 320 outputs the codes C1 for the eighty pixels after the voltage level shift to the data-line driving circuit 330 as the display data XDATA (80 bits).

The data-line driving circuit 330 grasps start timing of a second horizontal scanning period according to a rising edge at time t31 of the data transfer start pulse XSP and outputs, in synchronization with the rising edge of the system clock SCLK, the display data XDATA (80 bits) to the first to eightieth data lines 114 in the X direction as data signals d1, d2, . . . , and d80 for the eighty pixels. Consequently, black/white voltage corresponding to the first sub-frame SF1 is written in the first to eightieth pixels 110 connected to the second scanning line 112 in the Y direction.

Subsequently, when a rising edge of the next system clock SCLK occurs, the third selector 290 collectively selects, from digital codes input from the code converting circuit 280, the codes C1 for eighty pixels among the codes C1 to C81 included in digital codes respectively corresponding to the eighty first to one hundred sixtieth pixels 110 in the X direction and simultaneously outputs the codes C1 to the level shifter 320. The level shifter 320 outputs the codes C1 for the eighty pixels after the voltage level shift to the data-line driving circuit 330 as the next display data XDATA (80 bits).

The data-line driving circuit 330 outputs, in synchronization with the rising edge of the system clock SCLK, the display data XDATA (80 bits) to the eighty data lines 114, i.e., the eighty-first to one hundred sixtieth data lines 114 as data signals d81, d82, . . . , and d160 for the next eighty pixels. Consequently, black/white voltage corresponding to the first sub-frame SF1 is written in the eighty-first to one hundred sixtieth pixels 110 connected to the second scanning line 112 in the Y direction.

The operation explained above is repeated nine times every time the rising edge of the system clock SCLK occurs, whereby the black/white voltage corresponding to the first sub-frame SF1 is written in all the seven hundred twenty pixels 110 connected to the second scanning line 112 in the Y direction.

Further, the operation is repeated until the black/white voltage corresponding to the first sub-frame SF1 is written in all the seven hundred twenty pixels 110 connected to the four hundred eightieth scanning line 112 in the Y direction, whereby the black/white voltage is written in all the 720×480 pixels 110 in the first sub-frame SF1. An image corresponding to the first sub-frame SF1 is displayed.

Subsequently, when a rising edge of the scanning start pulse YSP occurs at time t4 and start timing of the second sub-frame SF2 comes, the scanning-line driving circuit 310 outputs, in synchronization with a rising edge at time t4 of the scanning transfer clock YCLK, the scanning signal G1 having the voltage VG to the first scanning line 112 in the Y direction. Consequently, the transistors 116 in the seven hundred twenty pixels 110 connected to the first scanning line 112 in the Y direction are turned on.

The third selector 290 collectively selects, in synchronization with a rising edge at time t4 of the system clock signal SCLK, from digital codes input from the code converting circuit 280, the codes C2 for eighty pixels corresponding to the second sub-frame SF2 among the codes C1 to C81 included in digital codes connected to the first scanning line 114 in the Y direction and respectively corresponding to the first to eightieth pixels 110 in the X direction and simultaneously outputs the codes C2 to the level shifter 320. The level shifter 320 outputs the codes C2 for the eighty pixels after the voltage level shift to the data-line driving circuit 330 as display the data XDATA (80 bits).

The data-line driving circuit 330 grasps start timing of a first horizontal scanning period according to a rising edge at time t4 of the data transfer start pulse XSP and outputs, in synchronization with the rising edge of the system clock SCLK, the display data XDATA (80 bits) to the first to eightieth data lines 114 in the X direction as data signals d1, d2, . . . , and d80 for the eighty pixels. Consequently, black/white voltage corresponding to the second sub-frame SF2 is written in the first to eightieth pixels 110 connected to the first scanning line 112 in the Y direction.

Subsequently, when a rising edge of the next system clock SCLK occurs, the third selector 290 collectively selects, from digital codes input from the code converting circuit 280, the codes C2 for eighty pixels among the codes C1 to C81 included in digital codes respectively corresponding to the eighty first to one hundred sixtieth pixels 110 in the X direction and simultaneously outputs the codes C2 to the level shifter 320. The level shifter 320 outputs the codes C2 for the eighty pixels after the voltage level shift to the data-line driving circuit 330 as the next display data XDATA (80 bits).

The data-line driving circuit 330 outputs, in synchronization with the rising edge of the system clock SCLK, the display data XDATA (80 bits) to the eighty data lines 114, i.e., the eighty-first to one hundred sixtieth data lines 114 as data signals d81, d82, . . . , and d160 for the next eighty pixels. Consequently, black/white voltage corresponding to the second sub-frame SF2 is written in the eighty-first to one hundred sixtieth pixels 110 connected to the first scanning line 112 in the Y direction.

The operation explained above is repeated nine times every time the rising edge of the system clock SCLK occurs, whereby the black/white voltage corresponding to the second sub-frame SF2 is written in all the seven hundred twenty pixels 110 connected to the first scanning line 112 in the Y direction.

Further, the operation is repeated until the black/white voltage corresponding to the second sub-frame SF2 is written in all the seven hundred twenty pixels 110 connected to the four hundred eightieth scanning line 112 in the Y direction, whereby the black/white voltage is written in all the 720×480 pixels 110 in the second sub-frame SF2. An image corresponding to the second sub-frame SF2 is displayed.

The operation for each of the sub-frames explained above is repeated up to the last sub-frame SFk that occurs at time tk, whereby image display for one frame starting from time t1 is completed.

Figure 8:
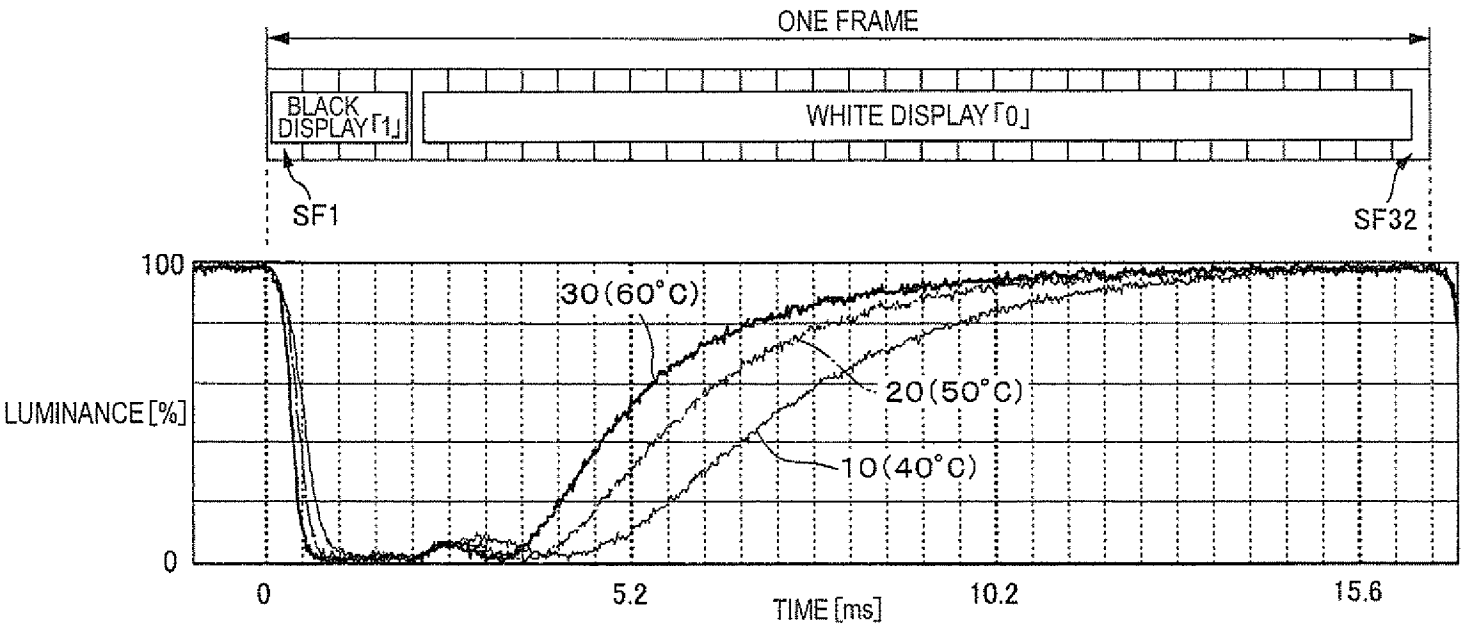
FIG. 8 is a first explanatory diagram for explaining a principle of gradation correction with respect to a temperature change in the liquid crystal device according to the embodiment.

With such operation of the liquid crystal device 100 according to this embodiment, it is possible to uniformalize response speed of the liquid crystal 105 irrespectively of a temperature change. A reason for this is explained below. FIG. 8 is a diagram representing transmittance characteristics of the liquid crystal 105 at temperatures (40° C., 50° C., and 60° C.) in the case in which one frame is divided into thirty-two sub-frames and first several sub-frames are for black display and the remaining sub-frames are for white display. In FIG. 8, reference numeral 10 denotes the transmittance characteristic of the liquid crystal 105 at 40° C., reference numeral 20 denotes the transmittance characteristic of the liquid crystal 105 at 50° C., and reference numeral 30 denotes the transmittance characteristic of the liquid crystal 105 at 60° C.

As shown in FIG. 8, it is seen that, when the black display is switched to the white display, as the temperature is higher, the transmittance of the liquid crystal 105 sharply rises (i.e., response speed is high) and, as the temperature is lower, the transmittance of the liquid crystal 105 gently rises (i.e., response speed is low).

Figure 9A:
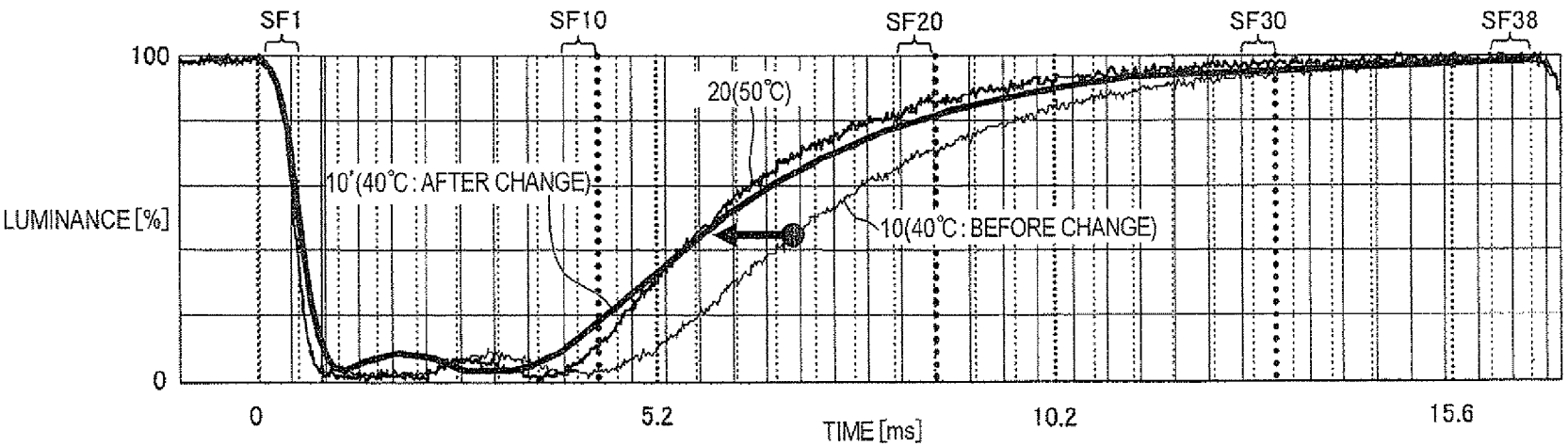
FIGS. 9A and 9B are second explanatory diagrams for explaining the principle of gradation correction with respect to a temperature change in the liquid crystal device according to the embodiment.
Figure 9B:
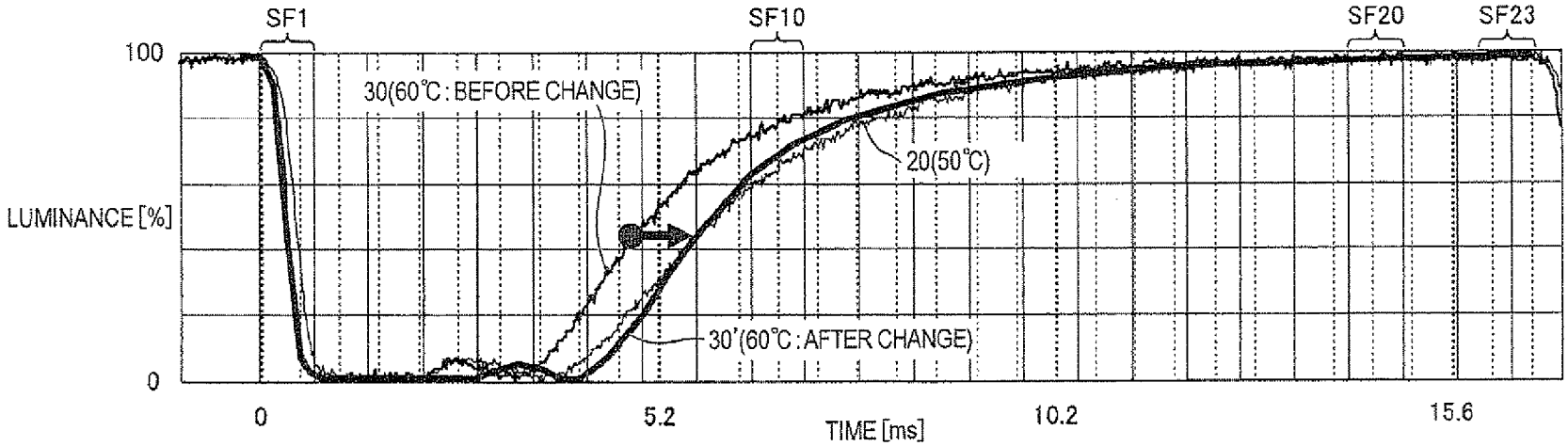

The number of sub-frames k in one frame is changed with reference to the transmittance characteristic 20 of the liquid crystal 105 at 50° C. For example, as shown in FIG. 9A, it is assumed that the number of sub-frames k is thirty-eight in the case of 40° C. and, as shown in FIG. 9B, the number of sub-frames k is twenty-three in the case of 60° C. As it is seen from FIG. 9A, in the case of 40° C., the transmittance sharply rises in a transmittance characteristic 10' after the change of the number of sub-frames compared with the transmittance characteristic 10 before the change of the number of the sub-frames. The transmittance characteristic 10' is close to the transmittance characteristic 20 at 50° C. On the other hand, as it is seen from FIG. 9B, in the case of 60° C., the transmittance gently rises in a transmittance characteristic 30' after the change of the number of sub-frames compared with the transmittance characteristic 30 before the change of the number of sub-frames. The transmittance characteristic 30' is close to the transmittance characteristic 20 at 50° C.

In this way, the number of sub-frames k in one frame is increased (one sub-frame period is shortened) to reduce processing time when temperature is low. This makes it possible to obtain an effect equivalent to an increase in the response speed of the liquid crystal 105. On the other hand, the number of sub-frames k in one frame is reduced (one sub-frame period is extended) to increase processing time for data when temperature is high. This makes it possible to obtain an effect equivalent to a reduction in the response speed of the liquid crystal 105. In other words, it is possible to uniformalize the response speed of the liquid crystal 105 irrespectively of a temperature change by setting the number of sub-frames k in one frame according to temperature.

As explained above, with the liquid crystal device 100 according to this embodiment, since it is unnecessary to use the lookup table and the Peltier element in the past, it is possible to perform gradation correction with respect to a temperature change without causing an increase in the size of the device and cost.

In the example explained in the embodiment, the number of expanded phases N is set to "80" in order to lower the frequency $f_{SCLK}$ of the system clock signal SCLK. However, it is not always necessary to perform phase expansion (i.e., N may be 1). In the explanation of the embodiment, the number of sub-frames k is set in the range of twenty to eighty-one according to temperature. However, the setting range of the number of sub-frames k only has to be appropriately set according to specifications of the liquid crystal device 100, characteristics of the liquid crystal 105, and the like. In the example explained in the embodiment, the VCXO 220 (the voltage-controlled crystal oscillator) is used as the system-clock generating unit. However, other voltage-controlled oscillators may be used as long as it is possible to generate the system clock signal SCLK.

Electronic Apparatus

An example of an electronic apparatus including the liquid crystal device 100 (the electro-optical device) is explained below.

(1) Projector

Figure 10:
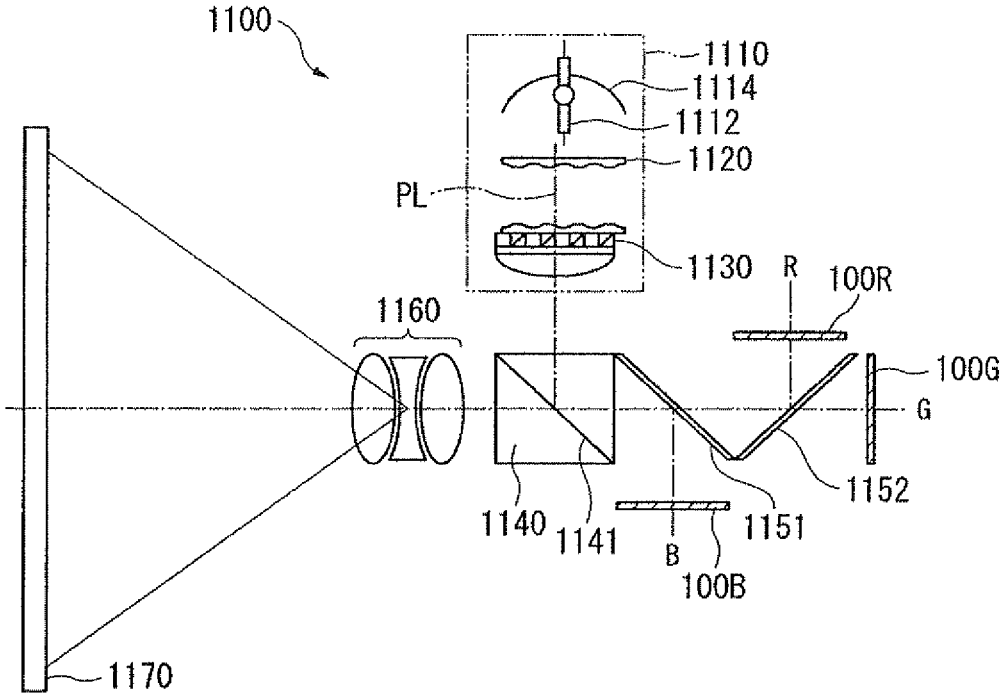
FIG. 10 is a diagram of a projector as an example of an electronic apparatus to which the liquid crystal device according to the embodiment is applied.

First, a projector employing the liquid crystal device 100 according to this embodiment as a light valve is explained. FIG. 10 is a plan view showing the configuration of the projector. As shown in FIG. 10, a polarized light illuminating device 1110 is arranged along a system optical axis PL in the inside of a projector 1100. In the polarized light illuminating device 1110, emitted light from a lamp 1112 is changed to substantially parallel light beams by reflection by a reflector 1114 and made incident on a first integrator lens 1120. Consequently, the emitted light from the lamp 1112 is divided into plural intermediate light beams. The divided intermediate light beams are converted into one kind of polarized light beams (s polarized light beams) having substantially aligned polarization directions by a polarized light converting element 1130 having a second integrator lens on a light incident side and are emitted from the polarized light illuminating device 1110.

The s polarized light beams emitted from the polarized light illuminating device 1110 are reflected by an s polarized light beam reflection surface 1141 of a polarization beam splitter 1140. Among the reflected light beams, a light beam of blue light (B) is reflected on a blue light reflection layer of a dichroic mirror 1151 and modulated by a reflective liquid crystal device 100B. Among the light beams transmitted through the blue light reflection layer of the dichroic mirror 1151, a light beam of red light (R) is reflected on a red light reflection layer of a dichroic mirror 1152 and modulated by a reflective liquid crystal device 100R. On the other hand, among the light beams transmitted through the blue light reflection layer of the dichroic mirror 1151, a light beam of green light (G) is transmitted through the red light beam reflection layer of the dichroic mirror 1152 and modulated by a reflective liquid crystal device 100G.

The red, green, and blue light beams respectively modulated by the liquid crystal devices 100R, 100G, and 100B in this way are sequentially combined by the dichroic mirrors 1152 and 1151 and the polarization beam splitter 1140 and then projected on a screen 1170 by a projection optical system 1160. Since light beams corresponding to the primary colors R, G, and B are made incident on the liquid crystal devices 100R, 100B, and 100G by the dichroic mirrors 1151 and 1152, a color filter is unnecessary. In this embodiment, the reflective liquid crystal devices are used. However, the projector may include transmissive display liquid crystal devices.

(2) Mobile Computer

Figure 11:
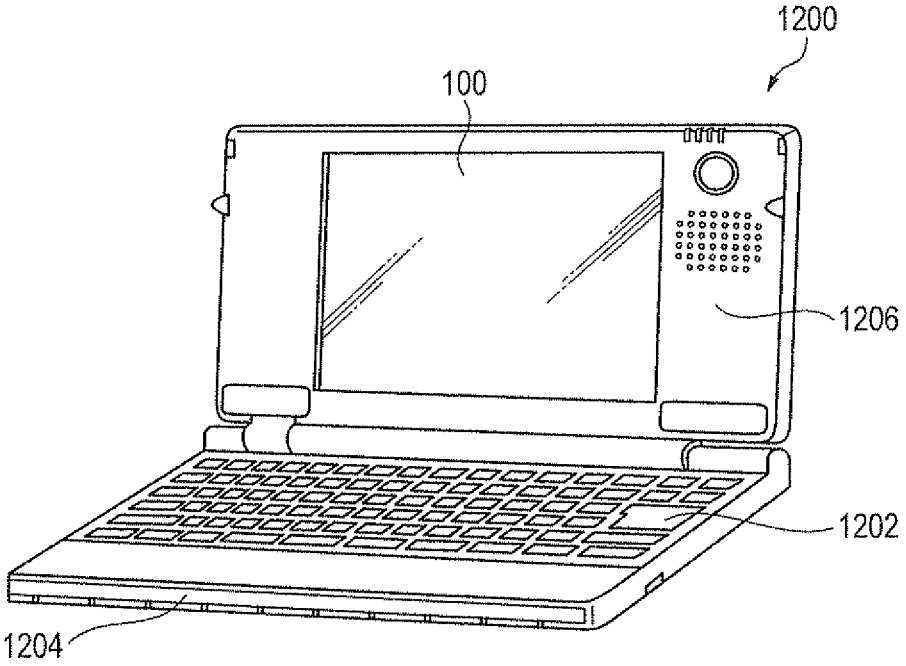
FIG. 11 is a diagram of a personal computer as an example of the electronic apparatus to which the liquid crystal device according to the embodiment is applied.

An example in which the liquid crystal device 100 is applied to a mobile personal computer is explained below. FIG. 11 is a perspective view showing the configuration of the personal computer. In the figure, a personal computer 1200 includes a main body unit 1204 including a keyboard 1202 and a display unit 1206. The display unit 1206 is configured by adding a front light to the front surface of the liquid crystal device 100. In this configuration, since the liquid crystal device 100 is used as a reflective direct view type, it is desirable that unevenness is formed in the pixel electrode 118 such that reflected light scatters in various directions.

(3) Cellular Phone

Figure 12:
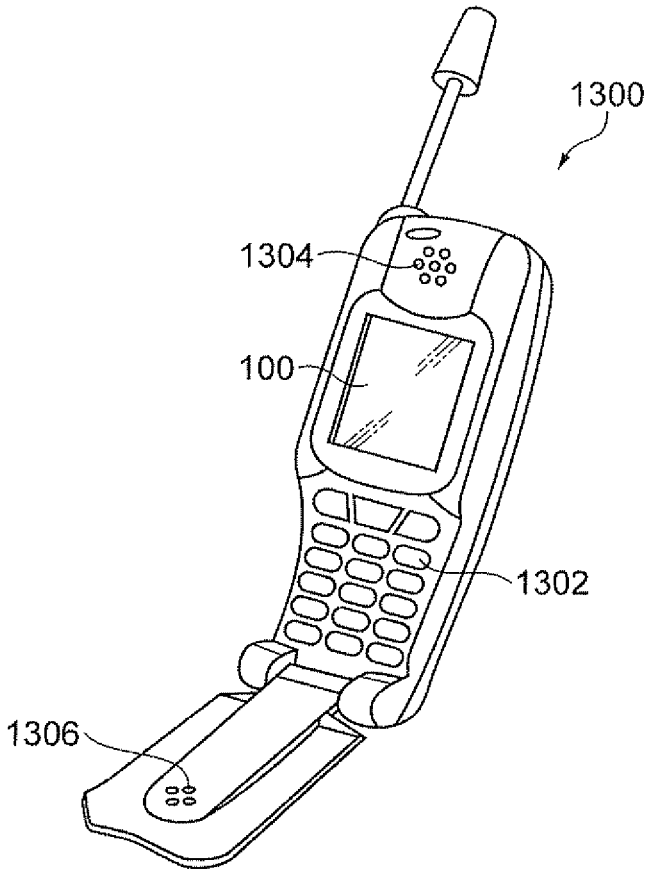
FIG. 12 is a diagram of a cellular phone as an example of the electronic apparatus to which the liquid crystal device according to the embodiment is applied.

An example in which the liquid crystal device 100 is applied to a cellular phone is explained below. FIG. 12 is a perspective view showing the configuration of the cellular phone. In the figure, a cellular phone 1300 includes the liquid crystal device 100 together with an earpiece 1304 and a mouthpiece 1306 besides plural operation buttons 1302. A front light is provided on the front surface of the liquid crystal device 100 when necessary. In this configuration, since the liquid crystal device 100 is used as the reflective direct view type, it is desirable that unevenness is formed in the pixel electrode 118.

Besides the apparatuses explained with reference to FIGS. 10 to 12, examples of the electronic apparatus include a liquid crystal television, video taper recorders of a viewfinder type and a monitor direct view type, a car navigation apparatus, a pager, an electronic notebook, an electronic calculator, a word processor, a workstation, a video phone, a POS terminal, and an apparatus including a touch panel.

What is claimed is:

1. A liquid crystal device comprising:

a temperature detecting unit configured to detect a temperature near a display area of the liquid crystal device;

a system-clock generating unit configured to dynamically set a number of sub-frames k included in one frame in response to the temperature detected by the temperature detecting unit, the frame having a constant frame frequency $f_{FM}$, the number of the sub-frames increasing in response to a decrease of the temperature detected by the temperature detecting unit, the number of sub-frames being within a predetermined range from a minimum number to a maximum number, and a frequency $f_{SCLK}$ of the system-clock generating unit is calculated based on Equation (1):

$$f_{SCLK} = f_{FM} \times k \times m \times \frac{n}{N} \qquad \text{Equation (1)}$$

a code generating unit configured to generate a digital code for a pixel, the digital code includes: (1) a black display code, (2) a gradation code, and (3) a keep code, the black display code including a predetermined number of bit data indicating a black level, the gradation code including a predetermined number of bit data indicating the black level or a white level configured to show a gradation, the gradation code following the black display code, the keep code including a predetermined number of bit data indicating the black level or a white level configured to keep a gradation, the keep code following the gradation code; and a controlling unit configured to control a luminance level of pixels in accordance with bit data included in the digital data generated by the code generating unit, wherein the black display code, the gradation code, and the keep code are predetermined for each gradation level, and a length from a head of the black display code to an end of the gradation code is substantially greater than the minimum number of the sub-frames, and m represents a number of scanning lines, n represents a number of data lines, and N represents a number of expanded phases.

2. The liquid crystal device according to claim 1, wherein a luminance level of pixels in a period of each of the plural sub-frames is set to at least a first level or a second level for performing gradation display, the first level is equivalent to a black display in which the luminance level of the pixels is 0, and the second level has a luminance level other than 0.

3. An electronic apparatus comprising the liquid crystal device according to claim 1.

4. The liquid crystal device according to claim 1, wherein the code generating unit includes:

a code converting unit that converts the image data output from the frame buffer into the digital code, and the liquid crystal device further comprises:

a system-clock generating unit that generates a system clock signal having a frequency corresponding to the temperature detected by the temperature detecting unit;

a writing control unit that controls writing of the image data in the frame buffer on the basis of a dot clock signal, a vertical synchronization signal, and a horizontal synchronization signal input together with the image data; and a readout control unit that controls readout of the image data from the frame buffer on the basis of the system clock signal and the vertical synchronization signal and performs setting of the number of sub-frames and control of the luminance level of the pixels in each of the sub-frames based on the digital code.

5. The liquid crystal device according to claim 4, wherein the temperature detecting unit outputs a voltage signal having a level corresponding to a detection result of the temperature, and the system-clock generating unit is a voltage-controlled oscillator that generates a system clock signal having a frequency corresponding to the level of the voltage signal.

6. A driving method for a liquid crystal device comprising:

detecting a temperature near a display area of the liquid crystal device;

dynamically setting a number of sub-frames k included in one frame in response to the temperature, the frame having a constant frame frequency $f_{FM}$, the number of the sub-frames increasing in response to a decrease of the detected temperature, the number of sub-frames being within a predetermined range from a minimum number to a maximum number, and a frequency $f_{SCLK}$ of the system-clock generating unit is calculated based on Equation (1):

$$f_{SCLK} = f_{FM} \times k \times m \times \frac{n}{N} \quad \text{Equation (1)}$$

generating a digital code for a pixel, the digital code includes: (1) a black display code, (2) a gradation code, and (3) a keep code, the black display code including a predetermined number of bit data indicating a black level, the gradation code including a predetermined number of bit data indicating the black level or a white level configured to show a gradation, the gradation code following the black display code, the keep code including a predetermined number of bit data indicating the black level or a white level configured to keep a gradation, the keep code following the gradation code; and controlling a luminance level of pixels in accordance with bit data included in the digital data generated by the code generating unit, wherein the black display code, the gradation code, and the keep code are predetermined for each gradation level, and a length from a head of the black display code to an end of the gradation code is substantially greater than the minimum number of the sub-frames, and m represents a number of scanning lines, n represents a number of data lines, and N represents a number of expanded phases.

* * * * *